United States Patent [19]

Wilzig et al.

[11] 4,159,838

[45] Jul. 3, 1979

[54] DOOR LATCH BOLT LOCKING DEVICE

[75] Inventors: Herbert Wilzig, Montebello; Charles J. Schuessler, Covina; Mark W. Stephens, Tustin, all of Calif.

[73] Assignee: Mark W. Stephens, Tustin, Calif.

[21] Appl. No.: 828,436

[22] Filed: Aug. 29, 1977

[51] Int. Cl.[2] ..... E05C 1/04; E05B 15/00

[52] U.S. Cl. ..... 292/150; 70/416; 70/418; 70/431; 70/447; 292/87

[58] Field of Search ..... 70/98, 99, 416, 431, 70/447, 418; 292/10, 67, 71, 87, 88, 89, 106, 150, 151, 152, 169.14, 179, 180, 189, 207, 208, 292, 295, 346, 341.15, 302

[56] References Cited

U.S. PATENT DOCUMENTS

| | | | |
|---|---|---|---|
| 543,142 | 7/1895 | Roberts | 292/153 |
| 543,908 | 8/1895 | Stone | 292/153 X |
| 880,621 | 3/1908 | Bowers | 292/341.15 X |
| 987,271 | 3/1911 | Upton | 292/10 |
| 1,014,583 | 1/1912 | Eisenhart | 292/153 |
| 1,126,375 | 1/1915 | Brinkerhoff | 292/150 |
| 1,160,505 | 11/1915 | Giles | 292/87 |
| 1,165,614 | 12/1915 | McCann | 292/150 |
| 1,324,949 | 12/1919 | Ziobro | 70/447 |
| 1,520,509 | 12/1924 | Rancour | 70/129 |
| 1,570,072 | 1/1926 | Merz et al. | 292/152 |
| 2,492,322 | 12/1949 | Russell | 292/346 X |
| 3,312,490 | 4/1967 | MacDonald | 292/153 |
| 3,318,123 | 5/1967 | Piazza | 292/150 X |
| 3,711,140 | 1/1973 | Onori | 292/87 |
| 3,773,369 | 11/1973 | Wersonik | 70/418 X |
| 3,806,176 | 4/1974 | Massie | 292/341.15 X |

FOREIGN PATENT DOCUMENTS

| | | | |
|---|---|---|---|
| 264355 | 9/1913 | Fed. Rep. of Germany | 292/150 |
| 810117 | 8/1951 | Fed. Rep. of Germany | 292/67 |
| 543596 | 6/1922 | France | 292/150 |
| 69961 | 1/1946 | Norway | 292/302 |

*Primary Examiner*—Thomas J. Holko
*Attorney, Agent, or Firm*—Poms, Smith, Lande & Glenny

[57] ABSTRACT

A door latch bolt locking device for use with a latch bolt having a transverse groove or kerf in its top surface and which will positively prevent the withdrawal of the latch bolt. The device comprises a slideable member adapted to be substantially flush with the intersecting edge surface of the door and the inner surface of the door. The slideable member will have a first portion which will be substantially flush with the inner surface of the door and an integral tongue portion at a right angle to the flat portion and adapted to be substantially flush with the edge surface of the door. The locking device is also provided with means for allowing the slideable member to be moved through a limited vertical distance in a substantially flush relationship with the door surfaces so that the tongue member can move into and out of the kerf provided in the latch bolt to thereby lock the door.

In a preferred embodiment, the locking device is provided with means for positively maintaining the slideable member in a bolt-locked position when subjected to vertical forces.

1 Claim, 3 Drawing Figures

4
2
6
II
22
24b
24a
24
32
7
30
33
12
27
8
26
27
26
14
20
22
II 2
22
24b
32
30
33
27
26
27
26
20
22
4

22
4
6
24b
24a
30
32
12
33
24
8
26
27
26
14
27
2
22

DOOR LATCH BOLT LOCKING DEVICE

BACKGROUND OF THE INVENTION

Field of the Invention

This invention broadly relates to closure fastners, and more particularly to a door latch bolt locking device for use with a door having a door-knob controlled retractable latch bolt provided with a kerf or groove for operation with the locking device of this invention.

Because key-controlled knob-actuated latch bolts are subject to comparitively easy jimmying, many and varied safety devices and guards have been devised and offered for use. Although many of these prior art adaptations well serve the purposes for which they have been perfected and used, they, for the most part, require extra keys and are often difficult to install and are consequently expensive. There has long existed a need for a readily applicable device which is simple to operate and not visually and physically obtrusive.

Accordingly, the primary object of this invention is to provide a door latch bolt locking device which can be simply attached to a door and which is physically and visually unobtrusive.

Another object of this invention is to provide a door latch bolt locking device which is adapted to positively prevent the retraction of the bolt from its door-locking position.

Yet another object of this invention is to provide a door latch bolt locking device which can only be operated from the inside of the door and is provided with means to positively lock the bolt and to make it non-tamperable with thin plastic cards or the like.

Other objects and advantages of the present invention will become apparent from the following description and claims, the novelty of the invention consisting in the features of construction, the combination of parts, the novel interaction of the parts, all of which are more particularly described in the following description and the accompanying drawings wherein:

SUMMARY OF THE INVENTION

Briefly, the door latch bolt locking device of this invention is intended for use with a latch bolt having a transverse groove or kerf in its top surface and which will positively prevent the withdrawal of the latch bolt and consequently the opening of the door. The device comprises a slideable member adapted to be substantially flush with the intersecting edge surface of the door and the inner surface of the door. The slideable member will have a first portion which will be substantially flush with the inner surface of the door and an integral tongue portion at a right angle to the flat portion and adapted to be substantially flush with the edge surface of the door. The locking device is also provided with means for allowing the slideable member to be moved through a limited vertical distance in a substantially flush relationship with the door surfaces so that the tongue member can move into and out of the kerf provided in the latch bolt to thereby lock the door. It is a feature of this invention that all operative portions of the device are flush with the door and therefore are not physically or visually obtrusive.

In the preferred embodiment, the locking device is provided with a means for positively maintaining the slideable member in a bolt-locked position when subjected to vertical forces.

DETAILED DESCRIPTION OF THE INVENTION

Figure 1:
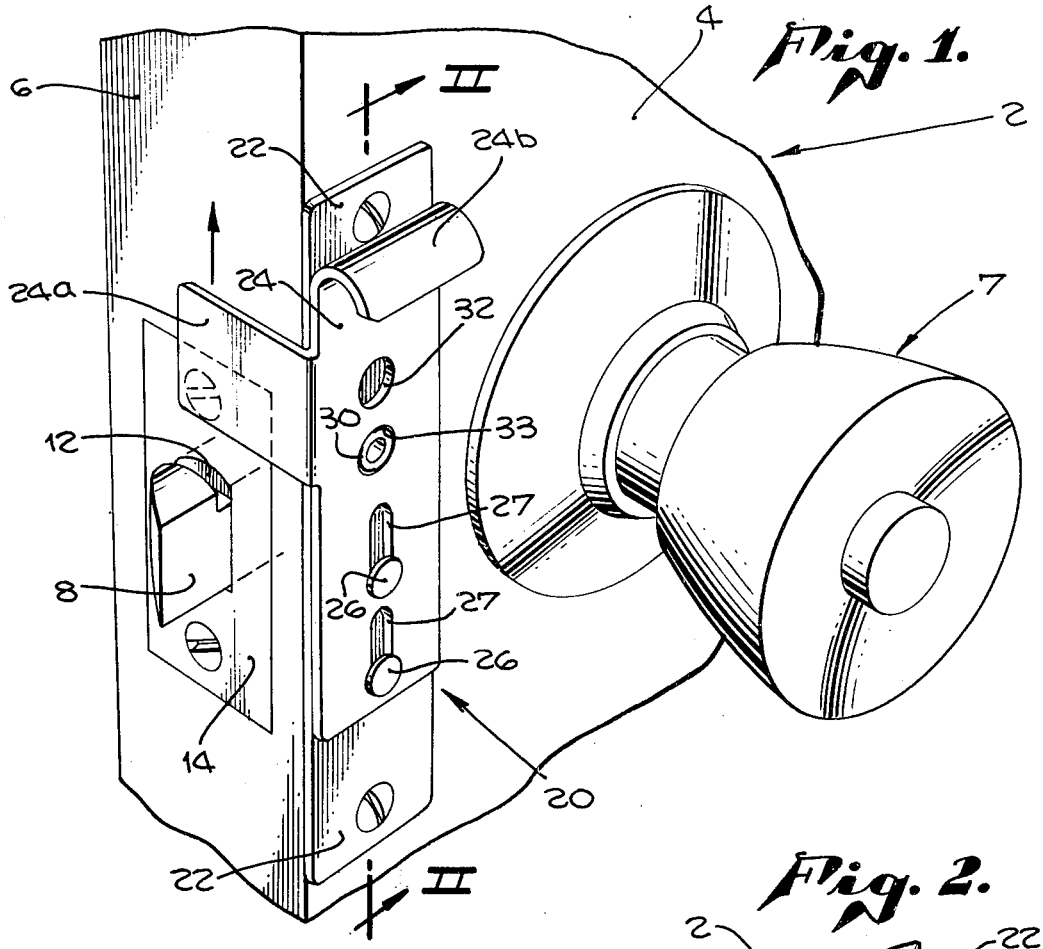
FIG. 1 is a sectional, perspective view of the door latch bolt locking device attached for use to a conventional door.

Referring specifically to FIG. 1, there is shown a section of a door 2, having an inner surface 4, and an edge surface 6. Attached to the door in a conventional manner is a door knob 7 and a door knob-actuated latch bolt 8. Latch bolt 8 is in its fully-extended door locking position, and there is shown a kert or groove 12 provided in the top of the bolt and located just beyond the surface of plate 14 when the bolt is in its fully-extended position.

Locking device 20, shown in its preferred embodiment has a flat door attachment plate 22 which is securely attached in a conventional manner to the door 2 on its inner surface 4 adjacent to the edge surface 6 of the door. Slideable member 24 is connected to attachment plate 22 by two retaining and guiding studs 26 which are integrally-connected to plate 22 to allow the slideable member 24 to move vertically and relatively freely within the limits of its vertical slots 27. The width of slots 27 are wider than the diameter of the stems of studs 26 but narrower than the heads of studs 26, thereby allowing the slideable member 24 to be moved vertically but yet still be retained and connected to the attachment plate 22.

Figure 3:
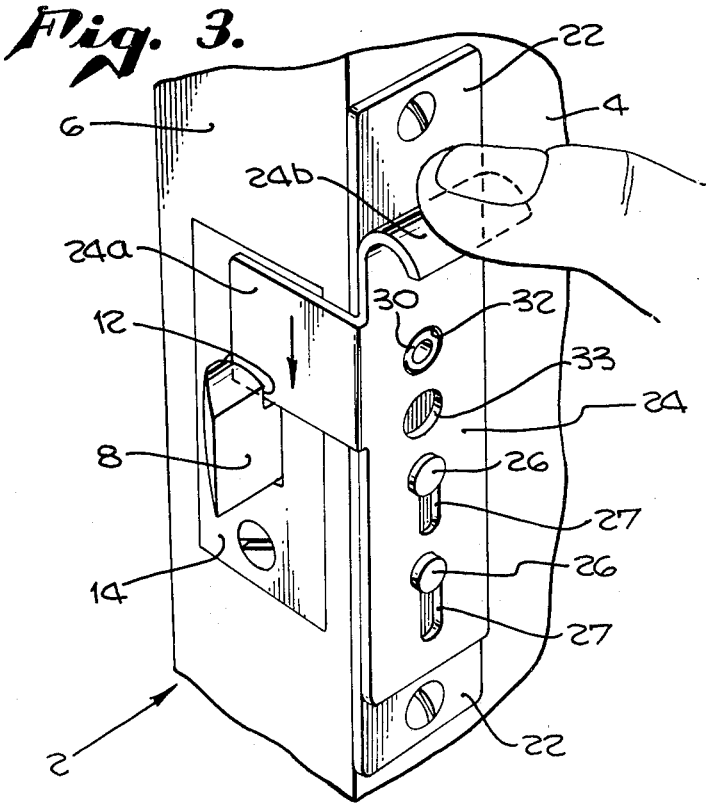
FIG. 3 is a sectional, perspective view of the locking device of this invention shown in its bolt locking position.

Slots 27 are designed to be of a length so that the slideable member can be moved down into its bolt-locked position as shown in FIG. 3 and moved up to a bolt-unlocked position as shown in FIG. 1.

As is seen in FIGS. 1 and 3, slideable member 24 is provided with an integral tongue member 24*a* which is at a right angle to the main portion of slideable member 24. It is tongue member 24*a* which is adapted to slide into the kerf 12 in bolt 8 to thereby lock the bolt 8 in its door-locking, fully-extended position. It is intended and desirable that tongue member 24*a* be disposed substantially flush with the edge surface 6.

An important feature of this invention is the provision of means which will positively maintain the slideable member in its bolt-locked position against any vertical forces that may be imparted to slideable member 24. This means will thereby keep the door locked and prevent the opening of the door by persons on the outside attempting to move the slideable member 24 out of its bolt-locked position. In the preferred embodiment, this means takes the form of a raised protuberance, boss, or button 30 integrally attached to the attachment plate 22, and a button-receiving opening 32 in the slideable member 24 located so that when the tongue member 24*a* is in kerf 12 (locking the bolt 8), the button 30 snaps into button-receiving opening 32. When in this condition, no anticipated vertical force will be able to move the slideable member 24 or its tongue member 24*a* out of the bolt-locked position.

Figure 2:
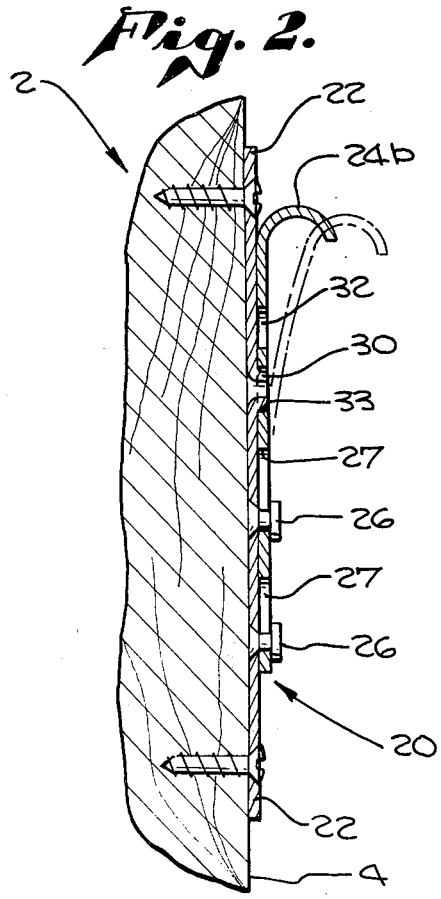
FIG. 2 is a side, cross-sectional view of the door and locking device of FIG. 1 taken along the line II—II.

To unlock the bolt 8, slideable member 24 may be provided with a pulling portion 24*b* at its top end. Pulling portion 24*b* can take many forms, but it is operated by pulling slideable member 24 away from attachment plate 22 and specifically moving button-receiving opening 32 out of engagement with button 30. Pulling portion **24*b* being pulled is shown in phantom in FIG. 2. Then slideable member 24 is slid upwards to move tongue member 24*a* out of engagement with kerf 12. Slideable member 24 may also be provided with a second button-receiving opening 33 which will receive button 30 and maintain the slideable member 24 in the unlocked position as shown in FIG. 1** so as to hold the locking device in the unlocked condition and to prevent it from accidently locking.

To assist in the operation of the slideable member 24, it is preferred that it be made of spring steel which will insure that the member 24 maintains its flat shape and to provide the necessary spring force which will cause the slideable member to snap over button 30 when moved from the locked to the unlocked position and vice versa.

The foregoing is considered as illustrative only. Furthermore, since numerous modifications and changes will readily occur to those skilled in the art, it is not desired to limit the invention to the exact construction and operation shown and described, and accordingly all suitable modifications and equivalents may be resorted to, coming within the scope of the invention.

We claim:

1. A door latch bolt locking device for use with a latch bolt having a transverse groove in its top surface to positively prevent the withdrawal of the latch bolt and the opening of the door, comprising:

a slideable member adapted to be disposed flushly with the intersecting edge surface of the door and the inner surface of the door, said member having a first flat portion adapted to be substantially flush with the inner surface of the door, and an integral tongue portion at a right angle to said first portion and adapted to be substantially flush with the edge surface of the door;

means for allowing said slideable member to be moved through a limited vertical distance in a substantially flush relationship with said door surfaces so that said tongue portion can move into and out of a received relationship with the transverse groove in the latch bolt; and means for positively maintaining said slideable member in the latch bolt-locked position when subjected to vertical forces, said maintaining means comprising a horizontally-extending member fixed to the inner surface of the door and adapted to be received by an opening in the slideable member; and said slideable member having an opening adapted to receive said horizontally-extending member in a snapping-in action and wherein said slideable member acts to receive and release said horizontally-extending member when said slideable member is pulled outwardly from its substantially flush engagement with the inner surface of the door, said slideable member being made of a material which will provide a biasing return force when the slideable member is pulled outwardly.

* * * * *